US005722202A

United States Patent [19]

Cooper

[11] Patent Number: 5,722,202

[45] Date of Patent: Mar. 3, 1998

[54] SEQUENTIAL DOOR CLOSING MECHANISM

[75] Inventor: Clinton T. Cooper, Youngstown, Ohio

[73] Assignee: SAFE-T-WAY, Salem, Ohio

[21] Appl. No.: 638,156

[22] Filed: Apr. 26, 1996

[51] Int. Cl.[6] ..... E05C 7/06

[52] U.S. Cl. ..... 49/109; 49/367

[58] Field of Search ..... 49/7, 105, 109, 49/110, 111, 112, 113, 114, 116, 366, 367

[56] References Cited

U.S. PATENT DOCUMENTS

| | | |
|---|---|---|
| 3,023,068 | 2/1962 | Haag . |
| 3,403,954 | 10/1968 | Williams . |
| 3,623,785 | 11/1971 | Williams . |
| 3,895,849 | 7/1975 | Zehr . |
| 4,146,994 | 4/1979 | Williams . |
| 4,191,412 | 3/1980 | LeKander . |
| 4,262,448 | 4/1981 | Filder . |
| 4,265,051 | 5/1981 | Williams . |
| 4,619,076 | 10/1986 | Livingston . |

*Primary Examiner*—Kenneth J. Dorner
*Assistant Examiner*—Curtis Cohen
*Attorney, Agent, or Firm*—Browdy and Neimark

[57] ABSTRACT

A mechanism for closing in sequence a first door (D1) and then a second door (D2) has pivot pins (40) mounted to the door frame. Each pin engages a cam plate (30), so that the plate can rotate. Linkages, such as doors arms (20) hinged from each door to the corresponding cam plate, cause the doors to close when the cam plates rotate. A pair of crossed shuttle arms (50, 60) are rotatably coupled to the cam plates. On the first cam plate the shuttle arms are fastened at a radial distance (d/2) from the pivot pin, and on the second the shuttle the shuttle arms are fastened at a greater radial distance (D/2). The two different distances cause the cam plates, as linked by the shuttle arms, to rotate at different angular rates. The door linked to the cam plate with the smaller distance closes first. The mechanism is asymmetrical with the distances from the pivots to the door arms, the lengths of the door arms, and the attachment points of the hasps on the two sides being in general unequal. The dimensions are adjusted for sequential closing of the doors.

15 Claims, 6 Drawing Sheets

SHUTTLE TIMING DIAGRAM

SEQUENTIAL DOOR CLOSING MECHANISM

FIELD OF THE INVENTION

The present invention relates to mechanisms for closing doors, especially for automatically closing two doors in sequence.

BACKGROUND OF THE INVENTION

In safety cabinets whose doors should close automatically when a fire or other emergency occurs, the doors are often of type with overlapping edges. (The doors may overlap to provide greater insulation of the inside of the cabinet, for example.) With overlapping door edges it is imperative that the doors close in a sequence. The door with the underlapped edge must close first, or the doors will jam instead of closing completely.

Several patents deal with safety cabinet door closure. Thus, U.S. Pat. No. 3,623,785 to Williams discloses a spring-biased door for a safety cabinet held open by fusible links.

U.S. Pat. No. 3,895,849 to Zehr discloses a storage cabinet for inflammable articles, in which one door closes before the other. Closing of the left door before the right is accomplished with a slide bar that checks the right-hand door's closing until the slide bar is pulled out of the way by the left-hand door. There is no rotational linkage of the left and right doors.

U.S. Pat. Nos. 4,146,994 and 4,265,051 to Williams show an apparatus similar to that of Zehr, using a pivoting stop 32 at the front of the cabinet. The same idea is repeated in U.S. Pat. No. 422,448 to Flider and U.S. Pat. No. 4,619,076 to Livingston.

All these prior-art patents allow the doors to close independently, but check the second door's motion until the first-closing door gets close to its closed position whereupon it trips a release, allowing the checked second door to then close all the way.

Such mechanisms are liable to fail because the trip mechanism is independent of (though actuated by) the doors, and each additional mechanism adds some chance of failure. Failure is especially likely when a sliding element is used. The prior-art mechanisms are such that if they do fail before an emergency requires automatic closure, users may not notice that the door-sequencing mechanism is faulty. (Users may also ignore evidence of a faulty mechanism, as long as the cabinet is operable at all.)

The prior-art mechanisms also depend upon somewhat precise positioning of the check stops and, if the trip mechanism is bent, may fail to catch either door as they should.

Finally, as the prior-art mechanisms do not link the motions of the two doors, they cause erratic and unconnected accelerations of the two doors, banging, and so on. Moreover, one door can "hang up" due to relatively minor friction that would be insufficient to stop the closing of both doors, with their greater momentum and/or doubled closing spring bias.

The prior art does not disclose a simple, reliable and inexpensive mechanism for closing first one door and then another, in which the sequential-closing mechanism smoothly links the motions of the two doors, requires no catching or trip devices, avoids banging, and has the safety feature of not allowing the doors to operate normally if the mechanism is faulty.

SUMMARY OF THE INVENTION

Accordingly, the present invention has an object, among others, to overcome deficiencies in the prior art such as noted above.

The present invention relates to mechanically-linked closure of two doors in a sequence: first the left door, then the right (or conversely), which is important when the cabinet doors have overlapping edges and the cabinets are intended to close automatically in case of a fire or like condition. The doors of the present invention may be spring-loaded to close but be held open by heat-fusible links that will melt in a fire and release the doors to close.

The invention controls the relative rotation rates of the first-closing and the second-closing doors; both start from similar wide-open positions, but the first door swings faster and is already resting against the cabinet frame when the second door arrives at the closed position.

To accomplish this, the mechanism uses the same principle used in gears: for a given distance moved at the circumference, a gear's rotation in degrees is proportional to the gear radius. For example, if two gears are linked by a long straight rod with gear teeth on one side of the rod engaging the teeth on each of the two gears, the rotation rates of the two gears will be proportional to their respective radii since their circumferential motions are each exactly equal to the displacement of the rod.

However, in this example the two gears will turn in the same sense of rotation (though at different rates) and if the two gears are mounted on doors, the doors will also turn in the same sense; one would open while the other were closing, or conversely. The doors' senses of rotation must be opposite if the doors are to close together.

The two doors can also be fastened to respective gears of different radii, but the gears can be joined by a flexible cogged belt instead of a rigid rod, and the belt can be twisted (making an "X" in the middle) so that the two gears turn in opposite senses instead of turning in the same sense, as with the rod. With this twisted belt set-up, the doors turn in opposite senses and also at different rates. (However, such a twisted-belt mechanism is not preferred because flexible belts made of rubber or plastic are likely to age and deteriorate, especially in industrial atmospheres, and cogged rubber belts and mating gears are expensive.)

The preferred embodiment of the present invention uses not gears but simple plates, called cam plates, which are linked to the doors and which rotate in a controlled angular ratio. The cam plates are linked by two long, rigid cam shuttle arms that cross one another between the cam plates, forming an "X" in plan view. The crossed shuttle arms are pivotally attached to the cam plates. On each cam plate the overlapping ends of each of the shuttle arms are pivoted to the cam plate at (preferably) a common distance from the pivot pin. Since the cam plate generally rotates about the pivot pin, the common distance is called a "radius". The common radius of the first cam plate (that is linked to the first door) is smaller than the common radius of the second cam plate; this radial difference causes the cam plate to rotate about its pivot pin at a higher angular rate.

Two shuttle arms are preferred because all the forces between the two cam plates can then be transferred by tension in one of the shuttles. If only one arm is used, then that single arm must be much stiffer so that it can resist compression, and this is more expensive. However, the present invention also contemplates a single arm that can resist compression.

Because the angle between the cam plates and the shuttle arms is not constant, the two cam plates will not only rotate but also translate, moving slightly closer and farther apart while relatively rotating. To allow for this translation, the cam plates have slots instead of round holes for engaging the pivot pins that are fixed to the cabinet; this allows for the to-and-fro translation of the two cam plates.

The cam plates are preferably mounted on the top inside surface of the cabinet on pivot pins that are fixed relative to the cabinet frame on which the doors are hinged. (The pivot pins and cam plates may also be mounted on a separate panel fastened to the frame or to an inside cabinet surface; such a panel is useful for retrofitting an existing cabinet.)

Each of the cam plates is linked to its respective door by a door arm. These door arms are preferably unequal in length and are attached to the doors at dissimilar locations, at least when the doors are similarly dimensioned. Likewise, the hasps by which the door arms are attached to the doors are set at different distances from their respective hinges, and the door arms are coupled to the cam plates at different distances on the two sides. The asymmetrical dimensions of the cam plate/door arm/hasp linkages allow the doors to close in sequence, even though each door rotates through the same total angle of about 180 degrees.

The invention may include springs and heat-fusible straps to close the doors automatically in a fire, when the straps melt and allow the springs to pull the doors closed.

The mechanism of the invention can be easily retrofitted to an existing cabinet by being mounted on a retrofit panel that is fastened into the cabinet.

BRIEF DESCRIPTION OF THE DRAWING FIGURES

The above and other objects and the nature and advantages of the present invention will become more apparent from the following detailed description of an embodiment taken in conjunction with drawings, wherein:

FIG. 1 is an exploded, perspective, partial view of the invention;

FIGS. 2*a* and 2*b* are plan views showing respectively the door-open position and door-closed positions of the mechanism;

DETAILED DESCRIPTION OF THE PREFERRED EMBODIMENT

Figure 1:
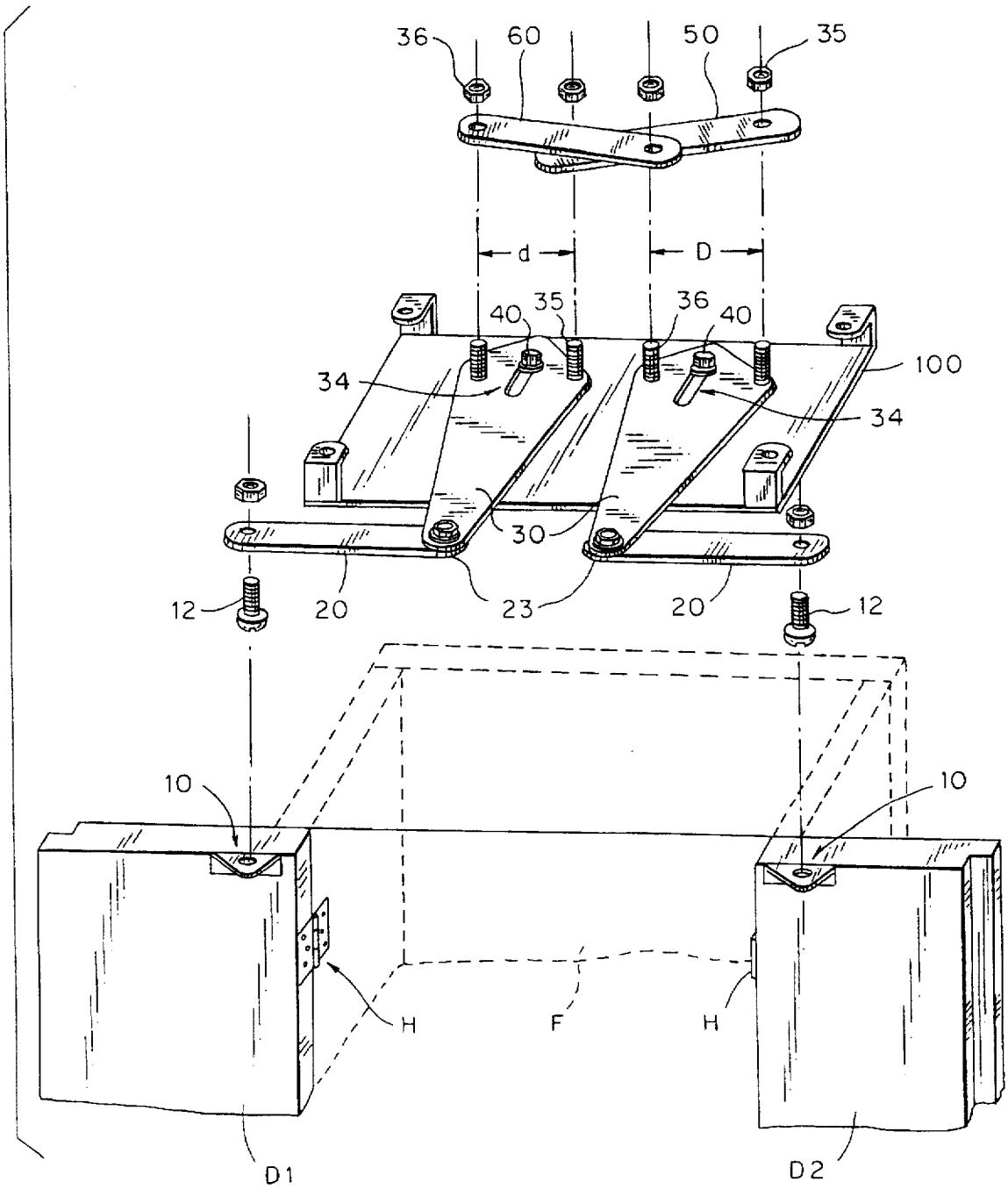

The invention has two corresponding sets of parts, some of which are preferably identical and several of which differ in dimension, but remain similar. In the following claims similar elements of these two sets are generally differentiated as "first" and "second", but in the drawing similar parts are denoted by the same reference numeral for clarity. These parts so identified are similarly shaped and have the same functions, but differ in dimensions and/or orientation.

FIG. 1 shows the present invention in exploded overview. The mechanism of the invention acts between brackets or hasps 10, attached to first-closing door D1 and to second-closing door D2, and pivot pins 40. The pins 40 are mounted to a retrofit panel 100 which in turn is fixed on the door frame F. The illustrated panel 100 has clips with screw holes for attachment to a cabinet roof. The doors D1 and D2 are themselves hinged to the frame F by hinges H. Thus, the mechanism links the doors to the frame. In an alternate embodiment the pivot pins 40 may be fixed directly to the frame F and the panel 100 be omitted.

The door frame F may be any sort of structure that will support the mechanism and the doors D1 and D2, such as a fire-resistant cabinet (shown in dashed outline in FIG. 1), a pair of posts, a rectangular structure, etc.

Each door D1, D2 has a hasp 10 rotatably engaging a door arm 20, which rotatably engages a cam plate 30, which engages the pivot pin 40. The two cam plates 30 are linked by crossed control arms or shuttle arms 50 and 60, each of which has a respective first end rotatably engaging the first cam plate 30 and a respective second end rotatably engaging the second cam plate 30. In FIG. 1, the first cam plate 30 is the one on the left side of the figure, which is linked to the under-lapped, first-closing, first door D1; the second cam plate 30 is linked to the overlapped door D2 on the right.

All the rotatable engagements are made by couplings 12, 23, 35, and 36. These couplings are preferably through bolts with lock nuts, but may be rivets, pins, bearings, or any other suitable means for rotatably coupling the engaged elements.

The engagement 34 between the cam plate 30 and the pivot pin 40 is not solely rotational, but must include a sliding component as well to accommodate the crossed shuttle arm lash. The coupling 34 includes a bolt through a slot rather than through a hole; this mounting allows the cam plate 30 to both slide and rotate on the pivot pin 40 as required. The coupling 34 might also be an equivalent alternative structure, such as a resilient member, eccentric, and so on. The cam plate 30 is primarily a rotator.

Figure 2A:
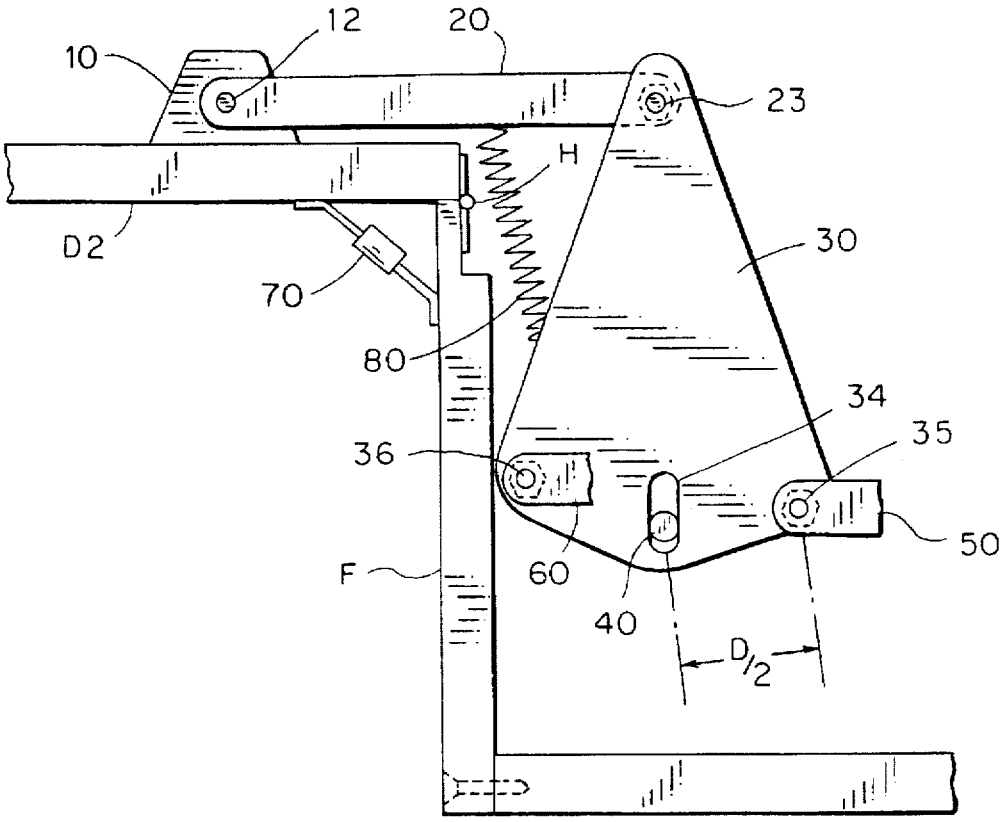
Figure 2B:
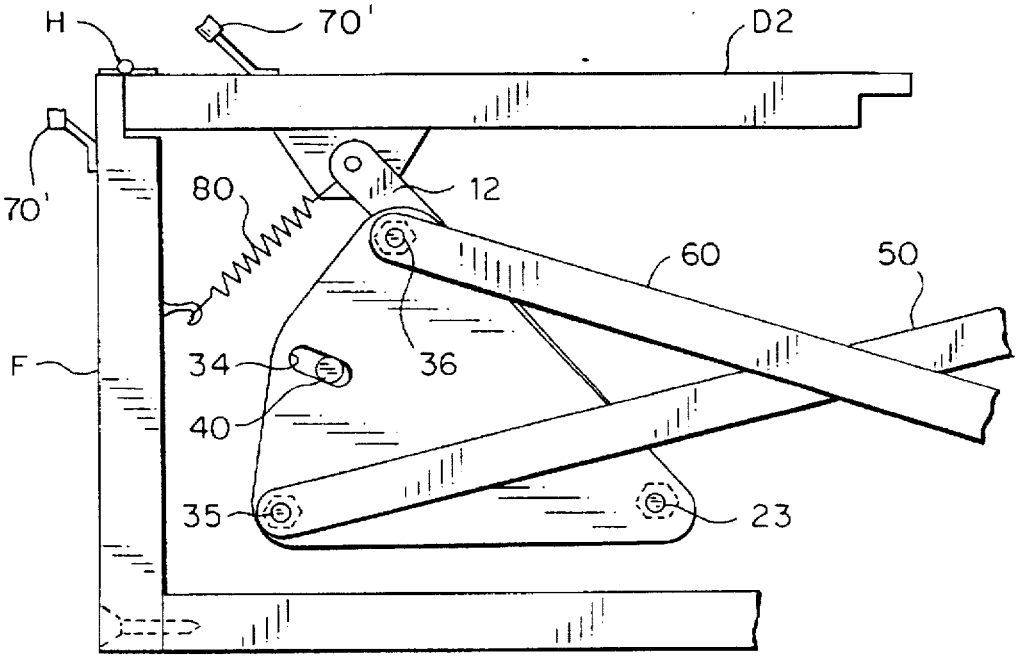

FIGS. 2*a* and 2*b* show the extreme positions of the second door D2, the second door arm 20, the shuttle arms 50 and 60, and the second cam plate 30, as the cam plate 30 rotates about the second pivot pin 40.

In FIG. 2*a* the door D2 is held open by a fusible tension link 70, but a stretched spring 80 urges the door D2 to close. If a fire occurs, the fusible link 70 melts and releases the door D2, which begins to close under the force of the spring 80. (The spring 80 could be replaced by a torsion spring on the cam plate 30, a sprung hinge; the combination of spring 80 and link 70 could be replaced by a steam cylinder; and so on.)

The door D2 is linked to the door D1 (not shown in FIGS. 2*a* and 2*b*) by the shuttle arms 50 and 60. In FIG. 2*a* the radial distance on the second cam plate 30 from the pivot pin 40 to the coupling 35 is shown as D/2; the radial distance from the pivot pin 40 to the coupling 36 preferably is also D/2.

The two sets of parts on either side in general have slightly different dimensions to effect the sequential door closing that is one object of the invention. The distances from the pivot 40 to the shuttle arm pivots 35, 36 are preferably identical on either cam plate 30, but smaller on the first-closing left door D1. These dimensions are indicated by a diameter "d" between the first couplings 36 and 35 on the left side of the drawing figure and a greater diameter "D" between the second couplings 36 and 35 on the right side of the drawing figure.

The common radial distance d/2, or D/2, is equivalent to the radius of a gear, and it relates to the timing of the sequential door closings. For this reason the arcs of the couplings 35 and 36, traced as the cam plate 30 rotates about the pivot pin 40, is called a "timing circle".

It will be apparent that the first cam plate 30 (not shown in FIGS. 2*a* and 2*b*), having a smaller timing circle than that of the second cam plate 30 (shown in FIGS. 2*a* and 2*b*), will rotate faster than the second cam plate 30.

The exact angular motions of the two cam plates 30 are a function of trigonometry; but to an approximation, the two cam plates act like two gears engaging a single twisted cogged belt and the ratio of rotations of the two plates is roughly proportional to the ratio of the timing circle radii.

Both the doors D1, D2 are preferably the same length, and both of the two doors preferably move through the same angle, 180 degrees, from wide-open to fully-closed; however the left door closes first. At first blush it might appear that the second door, revolving about its hinge at half the speed of the first door, would stop at a half-way position once the first door were seated; and indeed, this would happen if the cam plates were identically coupled to the doors. However, the cam plates' rotations are not directly proportional to the doors' rotations because the linkages are asymmetrical.

The pivot pins 40 themselves may be symetrically placed. Preferably, each pivot pin 40 is similarly placed relative to the cabinet frame as referenced by the adjacent hinge H. In the preferred embodiment, as sized for a cabinet 40 inches wide, the pins 40 are set toward the cabinet center line 4.3 inches from their respective hinges and are set 5.7 inches toward the back of the cabinet as measured from a line between the two sets of hinges H.

The adjustment of the doors' motions is accomplished by the correct dimensions of the linkages and the placement of the hasps 10. The dimensions are obtained by solving four simultaneous equations in three unknowns: the cam radius (center-to-center distance between pivot 40 and coupling hole 23); the length of each door arm 20 (between centers of holes 23 and 12); and the hasp radius (from hinge H to the center of the coupling hole of hasp 10). One pair of equations represents the extreme positions (i.e., fully open or closed) of the left door, and the other pair represents the extreme positions of the right door. These equations, based on familiar trigonometric formulas such as the pythagorean theorem and the law of cosines, can be generated and solved by conventional methods.

Exemplary dimensions for a 40-inch-wide cabinet are as follows. The first radius of the first timing circle (left side, d) is 0.8 inches, while 1.2 inches is the corresponding radius for the second timing circle (right side, D). On the left side the cam radius (center-to-center distance between pivot 40 and coupling hole 23) is 9.9 inches, while on the right it is 9.2 inches. The length of the left door arm 20 (between centers of holes 23 and 12) 11.56 inches, while the right door arm is 10.3 inches. On the left, the hasp radius (from hinge H to the center of the coupling hole of hasp 10) is 6.7 inches while on the right it is 5.4 inches. The shuttle arms are each 32.94 inches long on coupling hole centers.

Figure 3:
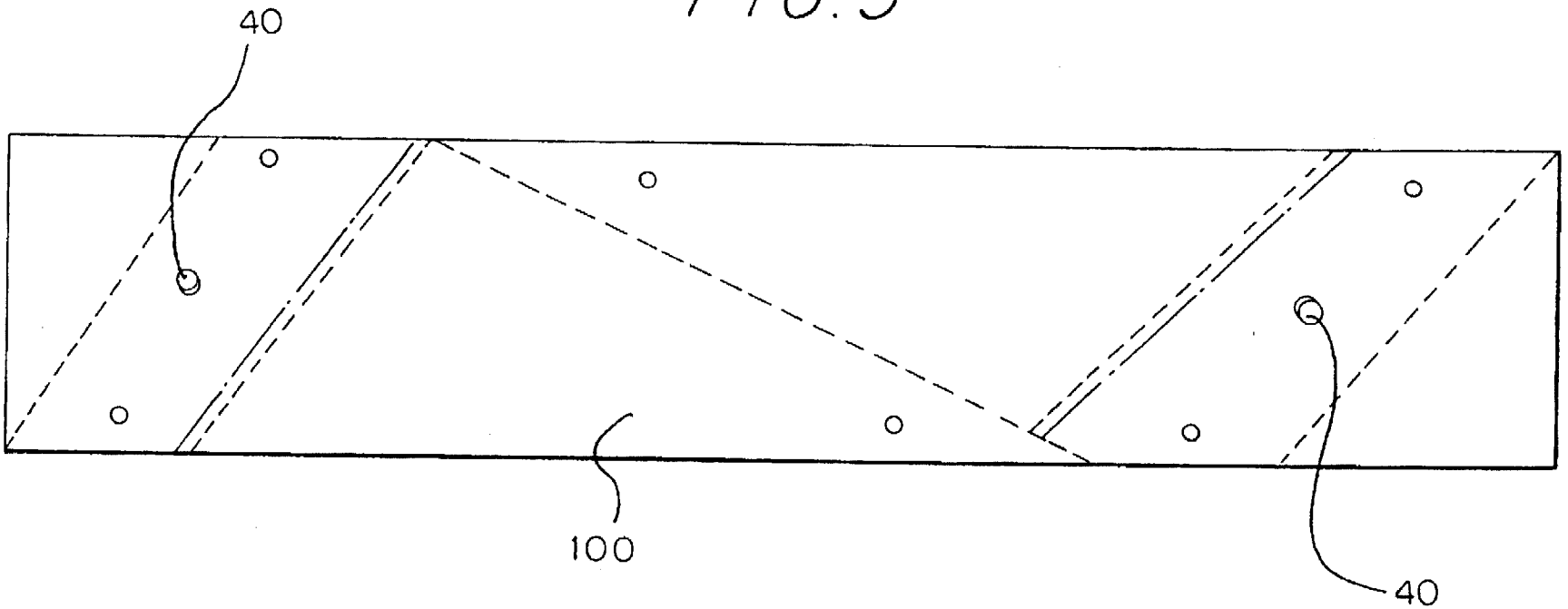
FIG. 3 is a schematic plan view showing the geometry of the invention.
Figure 4:
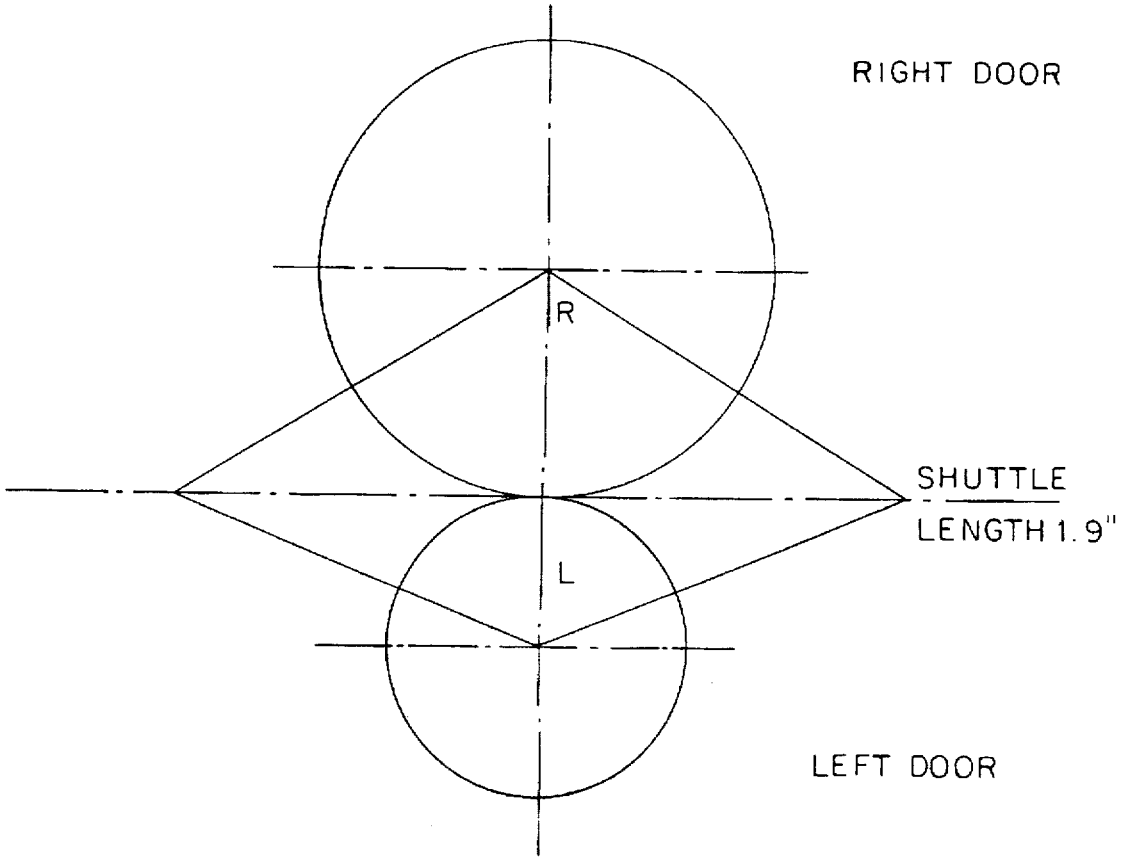
FIG. 4 is a shuttle timing diagram for the invention.
Figure 5A:
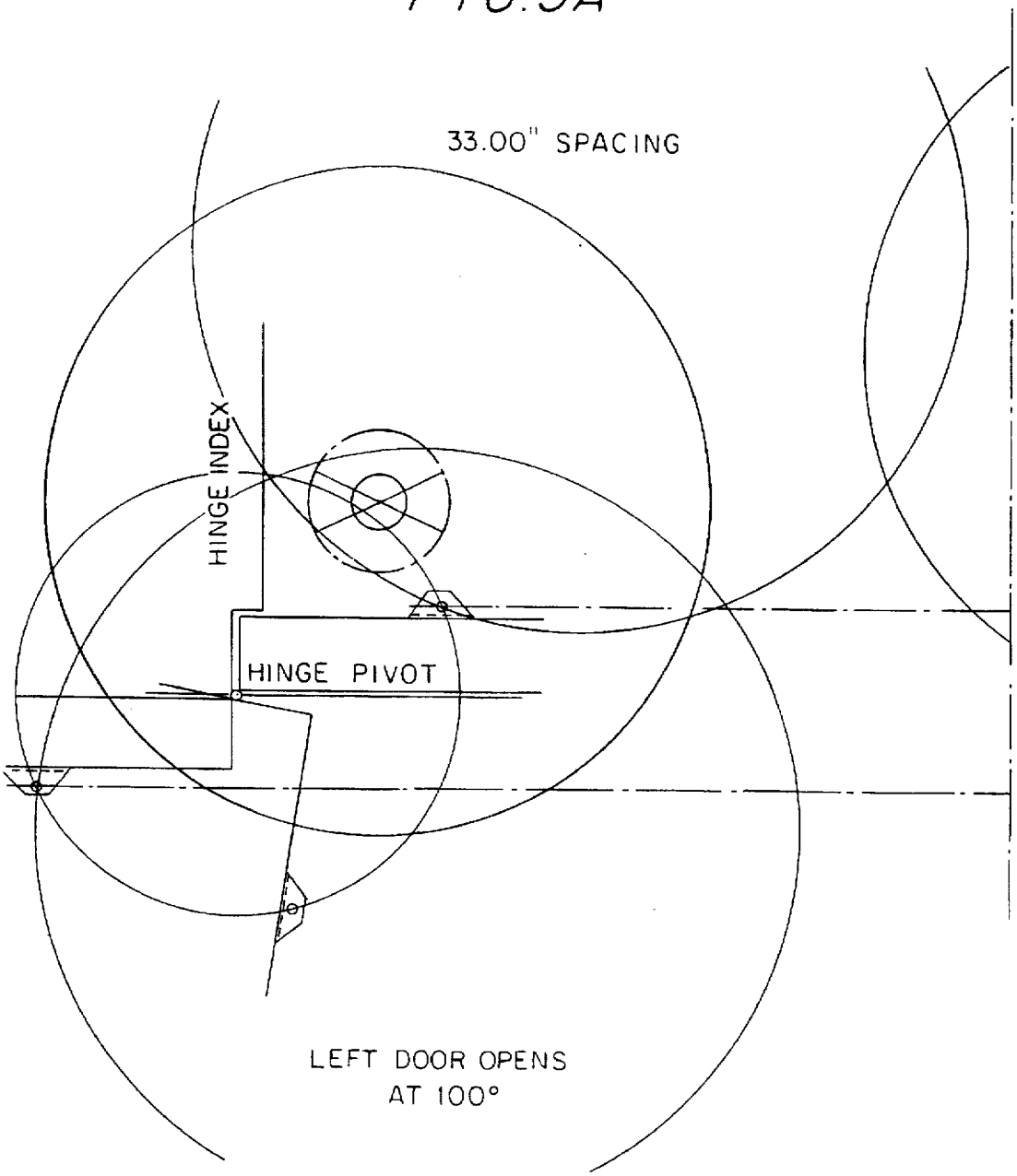
FIG. 5A is a circle layout diagram of the left door.
Figure 5B:
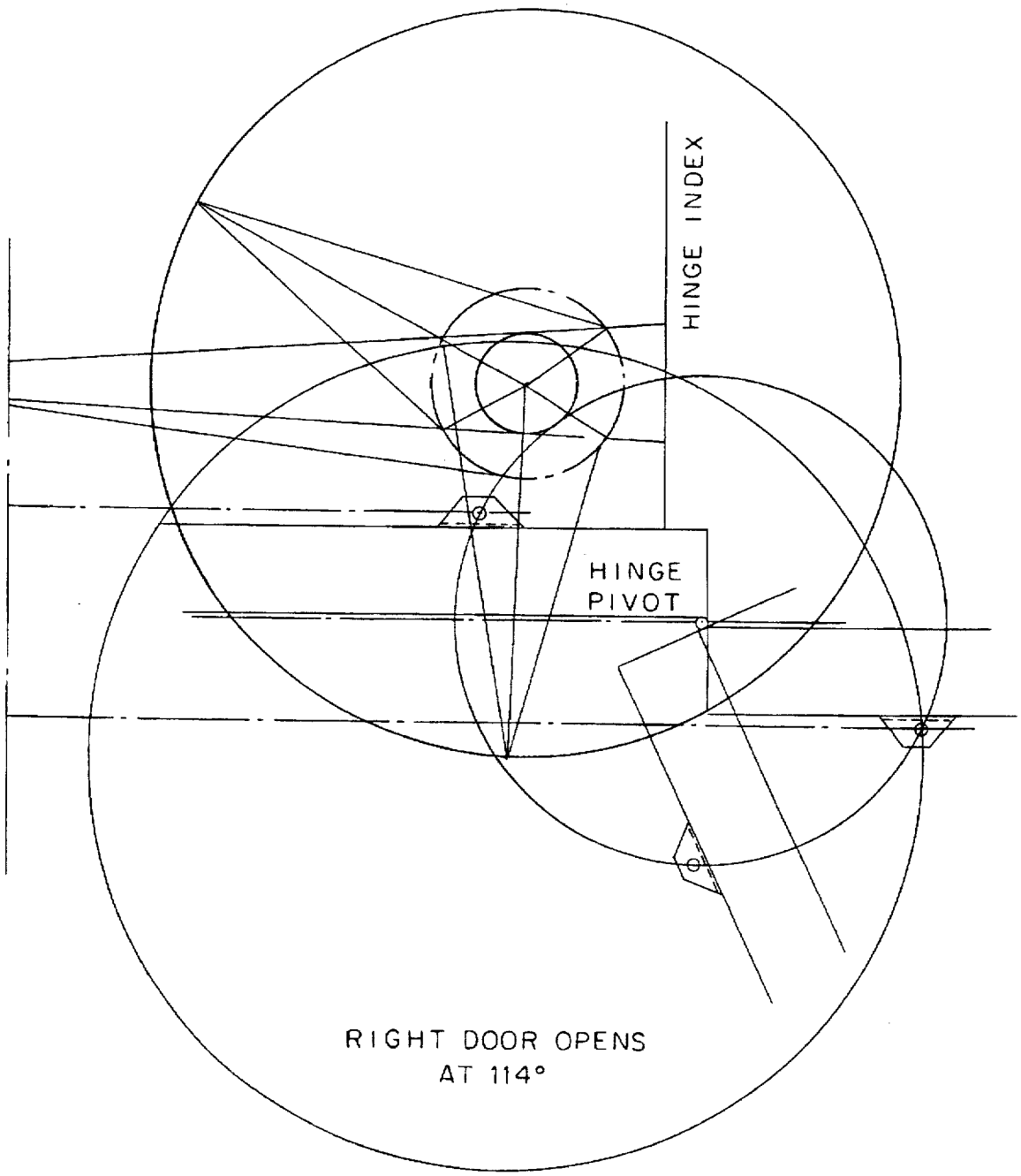
FIG. 5B is a circle layout diagram of the right door.

With these dimensions the left cam plate swings through an angle of 134.33 degrees while the left door swings through 180 degrees; meanwhile, the right cam plate swings through an angle of 115.45 degrees while the left door swings through 180 degrees. These exemplary relationships are shown in FIGS. 3–5.

The principle of the present invention is not altered if only one arm is provided between the two cam plates. However, two are preferred because a shuttle arm can support tension better than it can compression.

Although the preferred form of the cam plate is a stamped metal part as illustrated, the cam plate may also be tripod or other shape which can properly locate the arms and shuttles.

The invention also contemplates a mechanism in which the two doors close at the same rate, which is easily accomplished by making all the dimensions of the first parts and the second parts equal. This is useful in cases where the doors do not overlap.

The present invention is primarily intended for closing two doors vertically hinged about respective vertical axes, but is adaptable to doors hinged in other orientations.

The mechanism of the present invention insures that the two doors will close in sequence. It is inexpensive due to its use of metal parts that can be formed by stamping, drilling, and other quick operations. It is rugged and reliable, having no sliding parts which can easily seize. If the mechanism should seize, the doors will become inoperable and users will repair it; but seizure is unlikely because the mechanism is worked every time the doors are opened or closed in non-emergency use, and sticking or resistance will also get the attention of users.

Here, and in the following claims, the terms "upper" and "lower" are used for convenience and do not refer specifically to gravity's direction; these terms should not be construed as limiting the invention to placement of the mechanism in the top or bottom of a cabinet, the placement of door arms above or below the camp plates, and so on.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A door-closing mechanism adapted for use in closing two doors including a first door and a second door, the door mounted on hinges to a door frame, the door frame having a first fixed position and a second fixed position relative thereto; the mechanism comprising:

(a) a first pivot pin including means for mounting at the first fixed position of the door frame;

a second pivot pin including means for mounting at the second fixed position of the door frame;

(b) a first cam plate rotatably and linearly slidably mounted on the first pivot pin;

a second cam plate rotatably mounted and linearly slidably on the second pivot pin;

(c) a first linkage including means to couple the first cam plate to the first door;

a second linkage including means to couple the second cam plate to the second door; and (d) a first shuttle arm having a first shuttle arm first end rotatably coupled to the first cam plate at a first radial distance from the first pivot pin and a first shuttle arm second end rotatably coupled to the second cam plate at a second radial distance from the second pivot pin.

2. The mechanism according to claim 1, wherein:

the first linkage comprises a first door arm having a first plate end rotatably coupled to the first cam plate and a first door end including means to be rotatably coupled to the first door; and the second linkage comprises a second door arm having a second plate end rotatably coupled to the second cam plate and a second door end including means to be rotatably coupled to the second door.

3. The mechanism according to claim 1, wherein the first radial distance is less than the second radial distance.

4. The mechanism according to claim 1, wherein the first radial distance and the second radial distance are equal to one another.

5. The mechanism according to claim 1, comprising (e) a second shuttle arm having a second shuttle arm first end rotatably coupled to the first cam plate at the first radial distance from the first pivot pin and a second shuttle arm second end rotatably coupled to the second cam plate at the second radial distances from the second pivot pin.

6. The mechanism according to claim 5, wherein the first shuttle arm and the second shuttle arm are equal in length.

7. The mechanism according to claim 1, including means for urging the doors to a closed position.

8. The mechanism according to claim 7, including heat-fusible means for holding the doors in an open position.

9. The mechanism according to claim 1, including a retrofit panel including means to be mounted on the door frame, and wherein the first pivot pin and the second pivot pin are mounted on the retrofit panel.

10. The mechanism according to claim 2, wherein:

the first door arm is disposed on a first upper side of the first cam plate and the second door arm is disposed on a second upper side of the second cam plate;

the first shuttle arm and a second shuttle arm are disposed on a first lower side of the first cam plate and the second door arm is disposed on a second lower side of the second cam plate;

whereby the shuttle arms and doors arm do not interfere.

11. The mechanism according to claim 1, wherein:

the first linkage and the second linkage are asymmetrical, whereby the first door closes first.

12. The mechanism according to claim 11, wherein:

the first linkage comprises a first door arm having a first plate end rotatably coupled to the first cam plate and a first door end including means to be rotatably coupled to the first door; and the second linkage comprises a second door arm having a second plate end rotatably coupled to the second cam plate and a second door end including means to be rotatably coupled to the second door; and wherein a first door arm and the second door arm are unequal in length.

13. The mechanism according to claim 11, wherein:

the first linkage comprises a first door arm having a first plate end rotatably coupled to the first cam plate and a first door end including means to be rotatably coupled to the first door; and the second linkage comprises a second door arm having a second plate end rotatably coupled to the second cam plate and a second door end including means to be rotatably coupled to the second door; and wherein a first cam radius from the first pivot to a coupling between the first door arm and the first cam plate and a second cam radius from the second pivot to a coupling between the second door arm and the second cam plate are unequal.

14. The mechanism according to claim 11, wherein:

the first linkage comprises a first door arm having a first plate end rotatably coupled to the first cam plate and a first door end including a first hasp comprising means to be rotatably coupled to the first door; and the second linkage comprises a second door arm having a second plate end rotatably coupled to the second cam plate and a second door end including a second hasp comprising means to be rotatably coupled to the second door; and wherein the mechanism comprises means for a first radial distance from the first hasp to a hinge of the first door and a second radial distance from the second hasp to a hinge of the second door to be unequal in length.

15. A door-closing mechanism for closing two doors including a first door and a second door, the doors mounted on hinges to a door frame; the mechanism comprising:

(a) a first pivot pin and means for the first pivot pin to be held in a first fixed position relative to the door frame;

a second pivot pin and means for the first pivot pin to be held in a second fixed position relative to the door frame;

(b) a first rotator rotatably and linearly slidably mounted on the first pivot pin and having a first diameter;

a second rotator rotatably mounted and linearly slidably on the second pivot pin and having a second diameter;

(c) a first linkage and means for coupling the first rotator to the first door;

a second linkage and means for coupling the second rotator to the second door; and (d) means for rotationally coupling the first rotator with the second rotator for opposite-sense rotations.

* * * * *